US011215348B2

(12) United States Patent
Mangold

(10) Patent No.: US 11,215,348 B2
(45) Date of Patent: Jan. 4, 2022

(54) LUMINAIRE, ARRANGEMENT, PARTICULARLY DOOR CONTACT SWITCH, CIRCUIT BOARD AND USE

(71) Applicant: STEGO-HOLDING GMBH, Schwäbisch Hall (DE)

(72) Inventor: Elmar Mangold, Zöbingen (DE)

(73) Assignee: STEGO-HOLDING GMBH, Schwäbisch Hall (DE)

( * ) Notice: Subject to any disclaimer, the term of this patent is extended or adjusted under 35 U.S.C. 154(b) by 0 days.

(21) Appl. No.: 17/049,195

(22) PCT Filed: Apr. 18, 2019

(86) PCT No.: PCT/EP2019/060172
§ 371 (c)(1),
(2) Date: Oct. 20, 2020

(87) PCT Pub. No.: WO2019/206822
PCT Pub. Date: Oct. 31, 2019

(65) Prior Publication Data

US 2021/0325027 A1 Oct. 21, 2021

(30) Foreign Application Priority Data

Apr. 23, 2018 (DE) ..... 102018109656.9
Jul. 25, 2018 (DE) ..... 102018118000.4

(51) Int. Cl.
*F21V 23/00* (2015.01)
*F21V 25/12* (2006.01)
(Continued)

(52) U.S. Cl.
CPC ..... *F21V 23/005* (2013.01); *F21V 23/04* (2013.01); *F21V 25/12* (2013.01); *H01H 36/0006* (2013.01); *F21Y 2115/10* (2016.08)

(58) Field of Classification Search
CPC ..... F21V 23/005; F21V 23/04; F21V 25/12; H01H 36/0006–0066; H01H 35/022;
(Continued)

(56) References Cited

U.S. PATENT DOCUMENTS

D446,877 S 8/2001 Lester
D550,885 S 9/2007 Crosby
(Continued)

FOREIGN PATENT DOCUMENTS

AT 007212 U2 2/2006
DE 3011094 10/1981
(Continued)

OTHER PUBLICATIONS

Gerd Weichhaus, "Die LED-Schrankbeleuchtung mit Reed-Kontakt-Elektronische Basteleien," accessed on-line at: https://bastelnmitelektronik.jimdo.com/basteleien-ger%C3%A4te-und-schaltungen/weitere-schaltungen-ger%C3%A4te-und-basteleien/die-led-Schrankbeleuchtung, (Aug. 19, 2016).
(Continued)

*Primary Examiner* — Rajarshi Chakraborty
*Assistant Examiner* — Michael Chiang
(74) *Attorney, Agent, or Firm* — Barnes & Thornburg LLP

(57) ABSTRACT

A luminaire comprising a circuit board having at least one LED illuminant arranged on the circuit board, wherein the circuit board is arranged in a luminaire housing with a translucent housing section. The circuit board includes a switching device for switching the at least one LED illuminant on and off with at least one reed switch, wherein the reed switch is arranged on the circuit board between at least one power connection and the at least one LED illuminant
(Continued)

Figure 1:
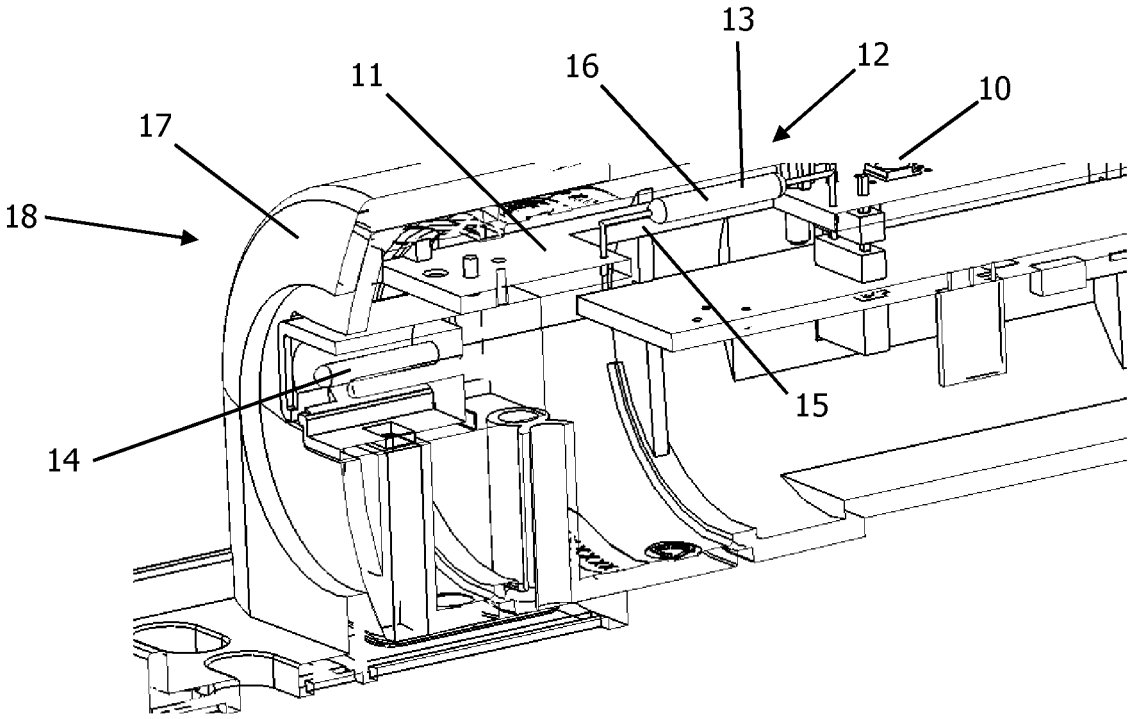

and is magnetically switchable for disconnecting or connecting a central power supply for the at least one LED illuminant.

11 Claims, 3 Drawing Sheets

(51) Int. Cl.
*F21V 23/04* (2006.01)
*H01H 36/00* (2006.01)
*F21Y 115/10* (2016.01)

(58) Field of Classification Search
CPC ... H01H 35/147; H01H 35/247; H01H 35/405
See application file for complete search history.

(56) References Cited

U.S. PATENT DOCUMENTS

| | | | | |
|---|---|---|---|---|
| D554,793 | S | 11/2007 | Bobel | |
| D556,359 | S | 11/2007 | Cunius | |
| D603,079 | S | 10/2009 | Toot | |
| 8,847,475 | B2 | 9/2014 | Heil et al. | |
| D750,308 | S | 2/2016 | Rodgers | |
| D754,902 | S | 4/2016 | Parker | |
| D785,229 | S | 4/2017 | Noh | |
| D796,106 | S | 8/2017 | Hoffmeister | |
| D796,721 | S | 9/2017 | Boorom | |
| D799,733 | S | 10/2017 | Recker | |
| D819,863 | S | 6/2018 | Deng | |
| D823,519 | S | 7/2018 | Adams | |
| D840,087 | S | 2/2019 | Zeng | |
| 10,203,084 | B1 * | 2/2019 | Huang | F21V 33/0076 |
| D844,880 | S | 4/2019 | Zeng | |
| D851,805 | S | 6/2019 | Chen | |
| D862,766 | S | 10/2019 | Kim | |
| D875,989 | S | 2/2020 | Xie | |
| D888,314 | S | 6/2020 | Mangold et al. | |
| 2015/0009660 | A1 * | 1/2015 | Lee | F21V 15/012 362/186 |
| 2015/0334790 | A1 * | 11/2015 | Scapa | H05B 45/325 315/294 |
| 2017/0365136 | A1 * | 12/2017 | Torre Sarmiento | F21S 9/022 |
| 2019/0123576 | A1 * | 4/2019 | Longo | F21V 23/04 |

FOREIGN PATENT DOCUMENTS

| | | |
|---|---|---|
| DE | 202009008284 U1 | 10/2009 |
| DE | 102010019875 | 11/2011 |
| EP | 2941096 | 11/2015 |
| WO | WO 95/22741 | 8/1995 |

OTHER PUBLICATIONS

Search Report & Written Opinion issued in Int'l App. No. PCT/EP2019/060172 (dated 2019).

* cited by examiner

LUMINAIRE, ARRANGEMENT, PARTICULARLY DOOR CONTACT SWITCH, CIRCUIT BOARD AND USE

CROSS REFERENCE TO RELATED APPLICATIONS

This application is a U.S. nationalization under 35 U.S.C. § 371 of International Application No. PCT/EP2019/060172, filed 18 Apr. 2019, which claims priority to German Patent Application No. 10 2018 109 656.9, filed 23 Apr. 2018 and German Patent Application No. 10 2018 118 000.4, filed 25 Jul. 2018. The disclosures set forth in the referenced applications are incorporated herein by reference in their entireties.

The invention relates to a luminaire, an arrangement with a luminaire, particularly a door contact switch, a circuit board with LED illuminants and the use of a luminaire.

A luminaire of the initially mentioned type is known from EP 2 941 096 A2, for example, and is designed with regard to the problem that replaceable LED-based illuminant units can be used in lighting arrangements. The currents supplied to the LEDs are specially adapted to ensure uniform and even light output.

The known luminaire has a control gear for this purpose, which provides a supply current depending on an identification circuit. The identification circuit is part of a circuit arrangement with several electrical resistors, of which at least a part can be optionally added to the identification circuit. A switching element is assigned to each of the resistors, wherein the illuminants interact with the respective switching elements. The switching elements can be activated contactless by reed contacts. In the above-mentioned, known resistor network the reed contact is essentially used statically.

The invention is based on the object of providing a luminaire which can be used in a system with several movement partners which are movable relative to each other. Depending on the position of the movement partners relative to each other, a certain function of the luminaire is to be triggerable. The invention is further based on the object of providing an arrangement, particularly a door contact switch, a circuit board and a use of the luminaire.

According to the invention, the object is solved with regard to the luminaire by the subject matter of claim 1. With regard to the arrangement, the circuit board and the use, the object is solved in each case by the subject matter of claims 6, 9 and 10.

Specifically, the object is solved by a luminaire having a circuit board with at least one LED illuminant, particularly having several LED illuminants, which are arranged on the circuit board. The circuit board is arranged in a luminaire housing with a translucent housing section. The circuit board has a switching device for switching the LED illuminant(s) on and off. The switching device comprises a reed switch located on the circuit board between at least one power connection and the LED illuminant(s). The reed switch is magnetically switchable to disconnect or connect a central power supply for the LED illuminant(s).

The invention comprises both a circuit board with a single LED illuminant and a circuit board with several LED illuminants. The following statements in connection with several LED illuminants also apply to a variant with a single LED illuminant.

In contrast to the known luminaire, in which the reed contacts are part of a resistor circuit and are used to adjust the supply current on some LED illuminants, the reed switch within the scope of the invention forms part of the switching device for switching the LED illuminants on and off. For this purpose, the reed switch is arranged between the at least one power supply and the LED illuminants and is magnetically switchable to disconnect or connect the central power supply for the LED illuminants. There are different variations: On the one hand, the reed switch can be designed and/or arranged to disconnect the circuit of the LED illuminant itself. On the other hand, the reed switch can be designed and/or arranged in such a way as to disconnect the circuit of the LED illuminant by means of a switching device. In this case, the switching device, e.g. a transistor, is controlled by the reed switch, which is preferably arranged in the circuit of the LED illuminant and then disconnects it to switch off the LED illuminant. This has the advantage that the reed switch, in comparison to the first variation, can work with smaller currents and can therefore be designed smaller, more sensitive and cheaper.

The luminaire according to the invention can therefore be used to connect a mechanical relative movement between movement partners, for example the opening or closing of a door, with a desired function, namely the switching on or off of the LED illuminant. The invention creates a solution that enables the switching on or off of the LED illuminants without contact. This allows maximum flexibility in the mechanical arrangement of the LED illuminants for switching on or off. The invention also represents a significant improvement in terms of design, because the conventional mechanical actuation, for example by moving the pin of a mechanical switch, and the associated design restrictions are eliminated. The luminaire has a simple design because the usual wiring is eliminated or at least simplified. According to the invention, an arrangement comprising a circuit board according to the invention or a luminaire according to the invention is further disclosed and claimed. The arrangement further comprises a means for generating a magnetic field, wherein the means for generating a magnetic field is arranged mechanically free from the circuit board or mechanically free from the luminaire. To actuate the reed switch, the means for generating a magnetic field on the one hand and the circuit board or the luminaire on the other hand are movable relative to each other.

Specifically, a door contact switch is disclosed, which implements the aforementioned arrangement according to the invention. The door contact switch thus comprises a printed circuit board or luminaire according to the invention and a means for generating a magnetic field which is arranged mechanically free from the printed circuit board or mechanically free from the luminaire. To actuate the reed switch, the means for generating the magnetic field on the one hand and the circuit board or luminaire on the other hand are movable relative to each other.

The door contact switch can be used in any environment. There are no restrictions here. The door contact switch according to the invention is especially preferred for use in electrical switch cabinets.

The means for generating a magnetic field can be, for example, a permanent magnet or a magnetic coil. The mechanically free arrangement of the means for generating a magnetic field in relation to the circuit board or the luminaire means that the means for generating a magnetic field can be added essentially freely.

The invention also discloses and claims the circuit board as such, i.e. independently of the luminaire.

Preferred embodiments of the invention are indicated in the subclaims.

Preferably, the entire electronics of the luminaire, including the circuit board, are completely encapsulated in the luminaire housing. This is made possible by the magnetic switchability of the luminaire according to the invention and thus the contactless interaction capability between a mechanical movement (e.g. a door with magnet) and the electronics of the luminaire. An advantage that arises from this is the high IP protection class that is achieved in this area. Openings in the luminaire housing, which would connect the electronics with the environment, are completely avoided. The electronics are thus ideally protected from the effects of weather and dust.

Due to the interaction of reed switch and magnet, the luminaire can be used in a potentially explosive region where a potentially explosive atmosphere occurs, because possible sparks (from the contact) and gas containing environment are safely separated.

Therefore, the invention also claims the use of the luminaire in a potentially explosive region in which a potentially explosive atmosphere can or does occur.

In a preferred embodiment, the reed switch bridges a recess in the circuit board, which is located between the power connector(s) and the LED illuminants. The recess in the circuit board has the advantage that the same circuit board can be used for different types of switches. For example, the circuit board can be used according to the invention as a switch in connection with the reed switch or in connection with known types of switches such as a toggle switch or a motion sensor.

The reed switch preferably comprises a tube in which ferromagnetic contact reeds are arranged which can be moved by applying a magnetic field. The reed switch can be designed as a normally open contact, in which the contact reeds are spaced apart in the rest state. Alternatively, the reed switch can be designed as an opener, in which the contact reeds touch each other in the rest state.

In connection with the arrangement according to the invention, one embodiment is provided in that the luminaire on the one hand and the means for generating a magnetic field on the other hand form movement partners which have at least one common stationary movement end region. The movement partners interact in the stationary movement end region to actuate the reed switch. This embodiment is realized, for example, in the case of the door contact switch according to the invention, if the luminaire is attached to one of the movement partners, e.g. the door frame, and the means provided for generating a magnetic field, e.g. a magnet, is attached to the other movement partner, e.g. the door.

The invention is described in more detail by means of an exemplary embodiment with reference to the attached schematic drawings.

Figure 2:
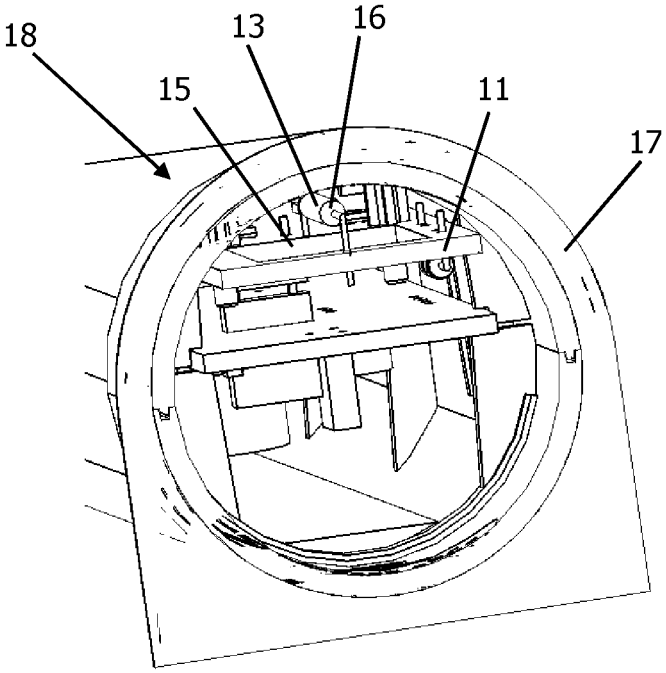
Figure 3:
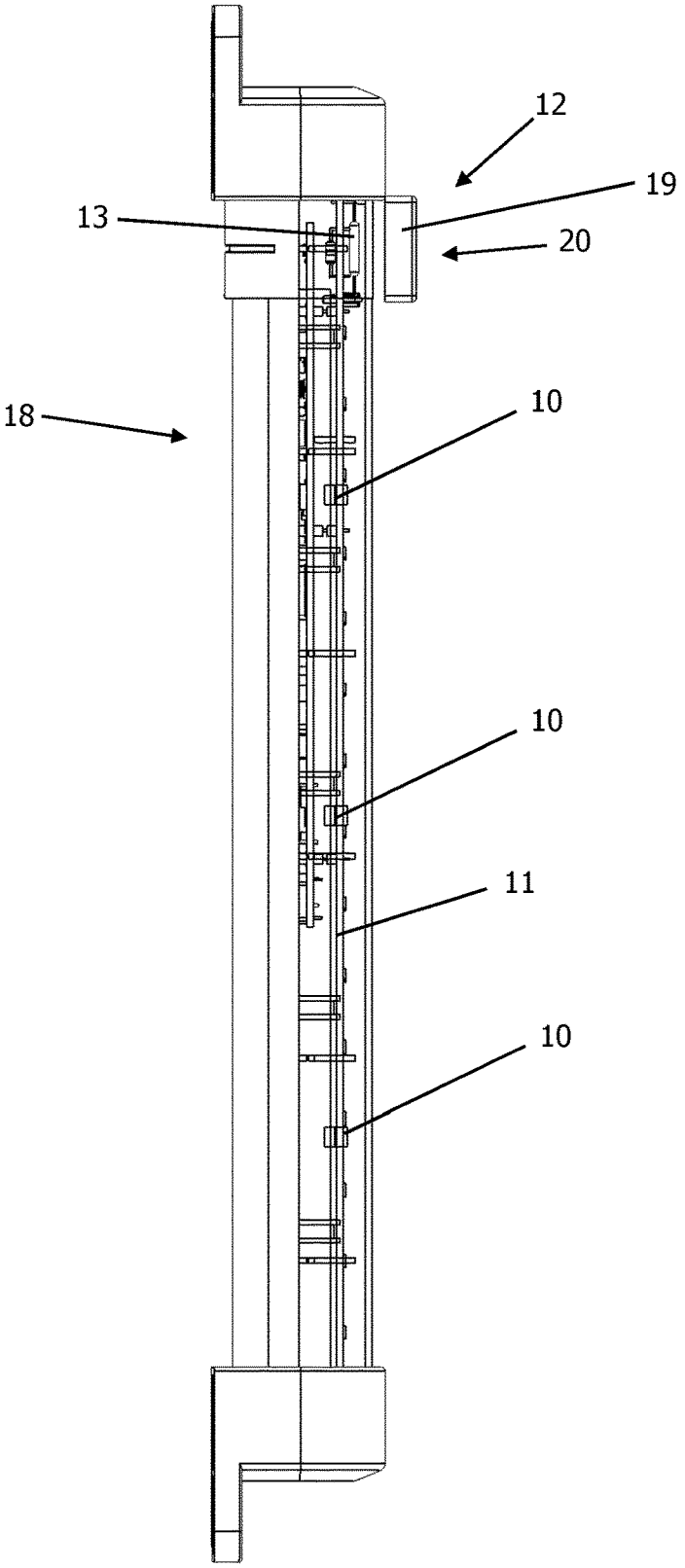
Figure 4:
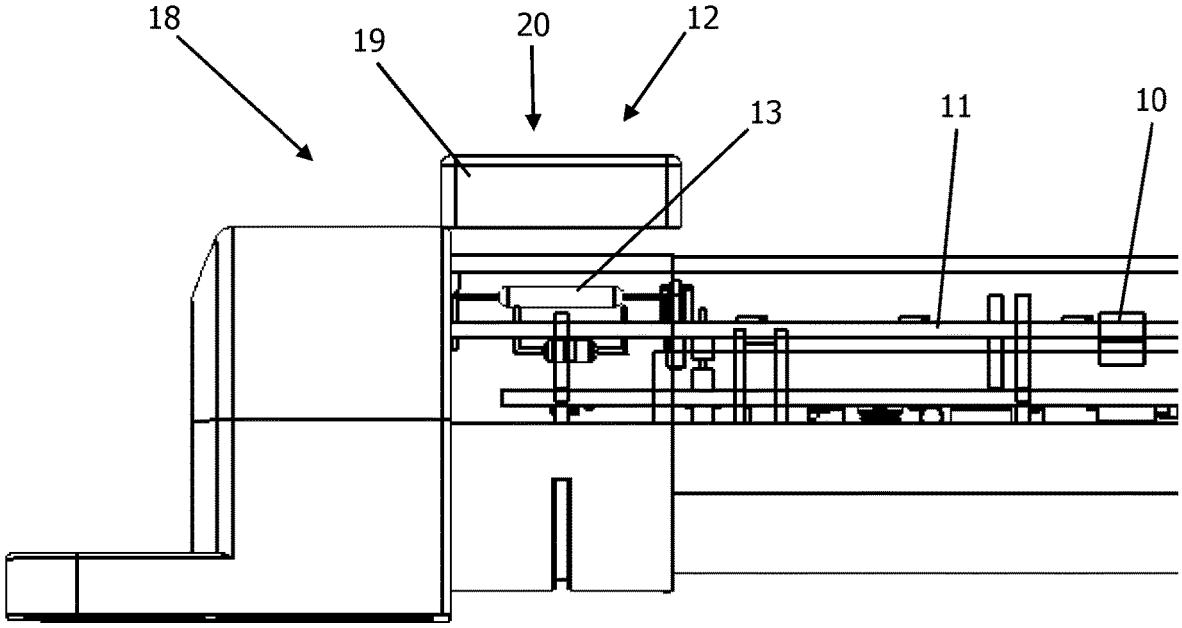

The drawings show as follows:

FIG. 1 shows a longitudinal section through a luminaire according to an exemplary embodiment according to the invention in the region of the reed switch FIG. 2 shows a cross-section through the luminaire according to FIG. 1 in the region of the reed switch FIG. 3 shows a side view of the luminaire according to FIG. 1 with a partial section along the circuit board and FIG. 4 shows a detailed view from FIG. 3 in the region of the switch.

FIG. 1 shows a circuit board 11 with LED luminaires 10, which are arranged on the circuit board 11. The circuit board is part of a luminaire 18, which is shown completely in FIG. 3, i.e. in its entire length. Circuit board 11 is arranged in a luminaire housing 17, namely in the area of a translucent housing section.

The entire electronics of luminaire 18 are completely encapsulated. This means that the luminaire housing 17 is hermetically sealed, so that no contact of the electronics located in the luminaire housing 17, including the circuit board 11, with the environment takes place. The luminaire 18 can therefore be used in potentially explosive regions or in areas where the luminaire is exposed to difficult weather conditions.

The luminaire 18 is part of an arrangement, particularly of a door contact switch, which can be attached to several, in particular two, movement partners, particularly is attached. In the example of the door contact switch, the two movement partners are on the one hand the door and on the other hand the associated door frame or a wall, in which or to which the door is attached.

The luminaire 18 can be attached to the door frame or another stationary component, for example. The counterpart to the luminaire 18, shown in FIGS. 3, 4, which is used to actuate the luminaire, i.e. to switch it on or off, is attached to the door (means 19).

The circuit board 11 has a switching device 12 for switching the LED luminaires on and off. Specifically, the switching device 12 includes a reed switch 13, which is clearly visible in FIGS. 1 to 4. The reed switch 13 is a switch known per se, which comprises a tube 16, in which contact reeds are arranged. The contact reeds are actuated or moved by a magnetic field which acts on the contact reeds.

The reed switch 13 is located between power connections 14 and the LED illuminants 10. The power connections belong to the central power supply of the LED illuminants 10. In other words, the reed switch 13 is located between the power connections 14 and the LED illuminants 10 in such a way that by actuating the reed switch 13, the power supply for the LED illuminants 10 is established or disconnected. The LED illuminants 10 are switched on or off. The power supply of the LED illuminants 10 is provided by conducting paths on the circuit board 11 (not shown), which electrically connect the reed switch 13 and the LED illuminants 10. Other power supply options are possible.

The power connections 14 are contacts that can be connected with a plug. The electrical connection between the power connections 14 and the reed switch 13 is made by wiring or by conducting paths on the board 11.

The circuit board 11 has a recess 15 in the area of the reed switch 13, so that the circuit board 11 can be equipped, for example, with a mechanical switch instead of the reed switch 13.

The circuit board can have several reed switches 13 for switching the LED illuminants 10 on or off.

The arrangement and the door contact switches are shown in FIGS. 3, 4, respectively. The arrangement includes the circuit board 11 shown in FIGS. 1, 2 and the luminaire 18, respectively. In addition, a means for generating a magnetic field 19 is provided, for example in the form of a permanent magnet. Other means for generating a magnetic field 19, for example a coil, are possible.

The circuit board 11 or the luminaire 18 on the one hand and the means for generating a magnetic field 19 on the other hand are mechanically independent of each other, i.e. structurally separated from each other. In other words, the above-mentioned components are not mechanically directly related to each other, but can be handled freely. When the arrangement is installed, the circuit board 11 or the luminaire 18 on the one hand and the means for generating a magnetic field 19 on the other hand form movement partners that can move relative to each other. For this purpose, the above-mentioned components can, for example, be attached to the door or the wall of a switch cabinet. The door and the component of the door contact switch attached to it form a first movement partner. The wall or a door frame or the other component of the door contact switch attached to it form the second movement partner. The movement partners can be moved relative to each other and have at least one common, stationary movement end region 20. In the example of the door this is the closed position. The movement partners cooperate in the stationary movement end region 20 to actuate the reed switch 13. The stationary movement end region 20 is recognizable in FIGS. 3, 4. There it is shown that the means for generating a magnetic field 19 is located directly above the switch 13, so that the reed switch 13 is in the magnetic field. Thus, the luminaire 18 can be operated contactlessly by the reed switch 13 in the desired way, if the door is closed or opened.

LIST OF REFERENCE NUMERALS

10 LED illuminant
11 Circuit board
12 Switching device
13 Reed switch
14 Power connections
15 Recess
16 Tube
17 Luminaire housing
18 Luminaire
19 Means for generating a magnetic field
20 Movement end region

The invention claimed is:

1. A luminaire comprising a circuit board having at least one LED illuminant arranged on the circuit board, wherein the circuit board is arranged in a luminaire housing with a translucent housing section, and having a switching device for switching the at least one LED illuminant on and off, wherein the switching device comprises at least one reed switch which is arranged on the circuit board between at least one power connection and the at least one LED illuminant, wherein the reed switch is magnetically switchable for disconnecting or connecting a central power supply for the at least one LED illuminant, wherein the reed switch bridges a recess in the circuit board, which is arranged between the power connection and the at least one LED illuminant.

2. The luminaire according to claim 1, wherein the entire electronics of the luminaire, including the circuit board, are completely encapsulated in the luminaire housing.

3. The luminaire according to claim 1, wherein the reed switch comprises a tube in which ferromagnetic contact reeds are arranged which are movable by application of a magnetic field.

4. The luminaire according to claim 3, wherein the reed switch is designed as a normally open contact, in which the contact reeds are spaced apart in the rest state, or as an opener, in which the contact reeds touch each other in the rest state.

5. The luminaire of claim 1 wherein the at least one LED illuminant comprises a plurality of LED illuminants.

6. An arrangement comprising a luminaire according to claim 1 and a means for generating a magnetic field, wherein the means for generating a magnetic field is arranged mechanically free from the luminaire, wherein for actuating the reed switch the means for generating a magnetic field and the luminaire are movable relative to each other.

7. The arrangement according to claim 6, wherein the arrangement forms a door contact switch.

8. The arrangement according to claim 6, wherein the luminaire and the means for generating a magnetic field form movement partners which have at least one common, stationary movement end region, wherein the movement partners interact in the stationary movement end region to actuate the reed switch.

9. A method of using the luminaire according to claim 1 in a potentially explosive region in which a potentially explosive atmosphere can occur or occurs.

10. A circuit board having at least one LED illuminant arranged on the circuit board, and having a switching device for switching the at least one LED illuminant on and off, wherein the switching device comprises at least one reed switch which is arranged on the circuit board between at least one power connection and the at least one LED illuminant, wherein the reed switch is magnetically switchable for disconnecting or connecting a central power supply for the at least one LED illuminant, and wherein the reed switch bridges a recess in the circuit board, which is arranged between the power connection and the at least one LED illuminant.

11. The circuit board of claim 10 wherein the at least one LED illuminant comprises a plurality of LED illuminants.

* * * * *